US005666817A

United States Patent [19]

Schulak et al.

[11] Patent Number: 5,666,817

[45] Date of Patent: Sep. 16, 1997

[54] ENERGY TRANSFER SYSTEM FOR REFRIGERATOR/FREEZER COMPONENTS

[75] Inventors: Edward R. Schulak, 567 Aspen, Birmingham, Mich. 48009; J. Benjamin Horvay, Isle of Palms, S.C.

[73] Assignee: Edward R. Schulak, Birmingham, Mich.

[21] Appl. No.: 761,329

[22] Filed: Dec. 10, 1996

[51] Int. Cl.[6] ..... F25D 17/02

[52] U.S. Cl. ..... 62/185; 62/183; 62/238.6; 62/434; 62/438; 62/440; 62/453; 62/260

[58] Field of Search ..... 62/238.6, 238.7, 62/238.1, 430, 434, 438, 440, 441, 453, 183, 180, 185, 188, 189, 260

[56] References Cited

U.S. PATENT DOCUMENTS

| | | | |
|---|---|---|---|
| 1,769,119 | 7/1930 | Davenport . | |
| 2,102,391 | 12/1937 | Steenstrup | 62/453 |
| 2,234,753 | 3/1941 | Frazer . | |
| 2,249,772 | 7/1941 | Maniscalco . | |
| 2,362,729 | 11/1944 | Smith . | |
| 2,517,686 | 8/1950 | Larkin . | |
| 2,579,056 | 12/1951 | Thompson . | |
| 2,655,795 | 10/1953 | Dyer . | |
| 2,690,653 | 10/1954 | Kleist | 62/430 |
| 3,017,162 | 1/1962 | Haines et al. . | |
| 3,123,986 | 3/1964 | Lukas et al. . | |
| 3,248,895 | 5/1966 | Mauer . | |
| 3,370,438 | 2/1968 | Hopkinson . | |
| 3,478,533 | 11/1969 | Kocher et al. . | |
| 3,500,655 | 3/1970 | Lyons . | |
| 3,785,168 | 1/1974 | Domingorene . | |
| 3,905,202 | 9/1975 | Taft et al. . | |
| 4,008,579 | 2/1977 | Horvay . | |
| 4,068,494 | 1/1978 | Kramer . | |
| 4,136,528 | 1/1979 | Vogel et al. . | |
| 4,210,000 | 7/1980 | Lee . | |
| 4,220,011 | 9/1980 | Berman et al. . | |
| 4,245,481 | 1/1981 | McDermott . | |
| 4,365,983 | 12/1982 | Abraham et al. . | |
| 4,437,317 | 3/1984 | Ibrahim . | |
| 4,474,022 | 10/1984 | Puskar . | |
| 4,735,059 | 4/1988 | O'Neal . | |
| 4,815,298 | 3/1989 | Van Steenburgh, Jr. . | |
| 5,050,398 | 9/1991 | Lane et al. . | |
| 5,070,705 | 12/1991 | Goodson et al. . | |
| 5,081,850 | 1/1992 | Wakatsuki et al. . | |
| 5,144,816 | 9/1992 | Chase . | |
| 5,291,749 | 3/1994 | Schulak . | |
| 5,402,651 | 4/1995 | Schulak . | |
| 5,520,007 | 5/1996 | Schulak . | |

FOREIGN PATENT DOCUMENTS

| | | |
|---|---|---|
| 2189693 | 1/1974 | France . |
| 17 79 653 B2 | 1/1978 | Germany . |
| 41 14 915 A1 | 11/1992 | Germany . |
| 43 00 750 A1 | 5/1993 | Germany . |
| 1508722 | 4/1978 | United Kingdom . |
| WO95/16887 | 6/1995 | WIPO . |

*Primary Examiner*—John M. Sollecito
*Attorney, Agent, or Firm*—Harness, Dickey & Pierce, P.L.C.

[57] ABSTRACT

An energy transfer system is provided for a refrigeration appliance. The energy transfer system includes a fluid passage disposed in the housing of the appliance for enabling the transfer of a fluid into, through, and out of the housing. The fluid is contained in a vessel which can be disposed outside of the home or underground so that the fluid is cooled by the outside air or by the ground.

18 Claims, 4 Drawing Sheets

ENERGY TRANSFER SYSTEM FOR REFRIGERATOR/FREEZER COMPONENTS

BACKGROUND OF THE INVENTION

FIELD OF THE INVENTION

The present invention relates to refrigerators and freezers. More particularly, the present invention relates to a system and method for utilizing cool outdoor ambient temperature levels to reduce the energy required to operate a refrigerator or freezer system.

BACKGROUND AND SUMMARY OF THE INVENTION

Virtually every home and apartment in this country has at least one refrigerator for storing perishable food products. Additionally, many households also have a freezer for storing food products over extended periods of time. As a consequence of such widespread usage, these domestic appliances consume a substantial part of the electrical energy which is generated by the nation's utility companies. In this regard, it should be noted that despite recent strides, refrigerators are still only half as efficient as the theoretical limit, the Reverse Carnot Cycle. Consequently, a substantial opportunity still exists to increase the energy efficiency of domestic refrigeration appliances. Since even the newest refrigerators consume approximately 700 kwh of electricity per year, it should be understood that a substantial need still exists to increase the energy efficiency of domestic refrigeration appliances.

Accordingly, it is a principle objective of the present invention to provide a system and method which reduces the energy required to operate a domestic refrigerator and freezer systems.

To achieve the foregoing objectives, the present invention provides an energy transfer system for a refrigeration appliance. The energy transfer system includes a fluid passage disposed in the housing of a refrigeration appliance to enable transfer of a fluid into, through, and out of the housing. The fluid is contained in a vessel which can be disposed outside of the home or underground so that the fluid is cooled by the outside air or by the ground. A set of conduits is provided which includes a first conduit to enable transfer of fluid from the vessel to the housing, and a second conduit to enable transfer of the fluid from the housing back to the storage vessel. Each of these conduits are disposed such that they extend through an external wall of the building.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
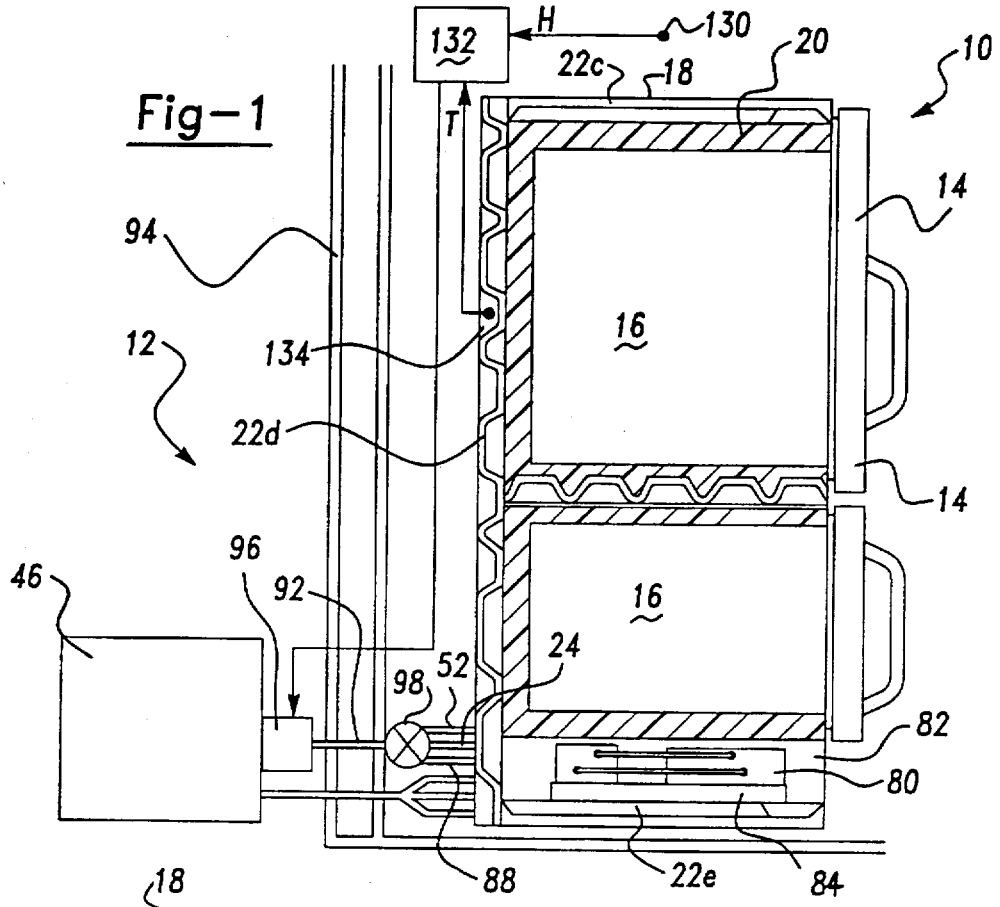
FIG. 1 is a schematic view of a household refrigeration appliance in accordance with the present invention.

Referring to FIG. 1, a schematic view of a household refrigeration appliance 10 in accordance with the present invention is shown. More specifically, the household refrigeration appliance 10 depicted in FIG. 1 is a domestic refrigerator which includes an energy transfer system 12 in accordance with the present invention. It should be appreciated that the present invention is preferably directed at household refrigeration appliances, such as self-contained refrigerators and freezers, that are specifically adapted for use in a home environment. In this regard, it should also be understood that the present invention may be employed with commercial refrigeration equipment.

As shown in FIG. 1, the refrigerator 10 generally includes at least one door 14 across its front to enable access to cooling storage compartments 16. In FIG. 1, two cooling storage compartments 16 and two doors 14 are shown.

Refrigerator 10 includes a housing 18 which surrounds the cooling storage compartments 16. Insulating material 20 is provided around each of the cooling storage compartments 16. According to a preferred embodiment of the present invention, a plurality of rollbond panels **22*a*–22*e* are disposed in the rear wall, side walls, upper wall, and lower wall of the housing 18. The rollbond panels 22*a*, 22*b* provided in the side walls of the housing 18 as well as the rollbond panel 22*c* provided in the upper wall of housing 18, include a serpentine passage 23 which connects a first inlet 24 to a first outlet 26**.

Figure 2:
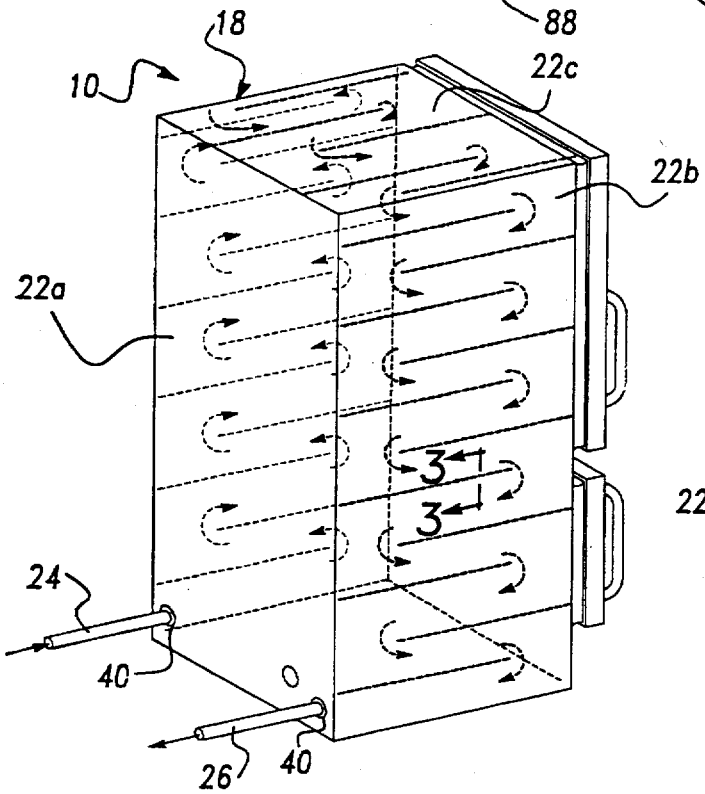
FIG. 2 is a perspective view of the refrigerator shown in FIG. 1, illustrating the passages disposed in the side walls and top of the refrigerator housing.
Figure 3:
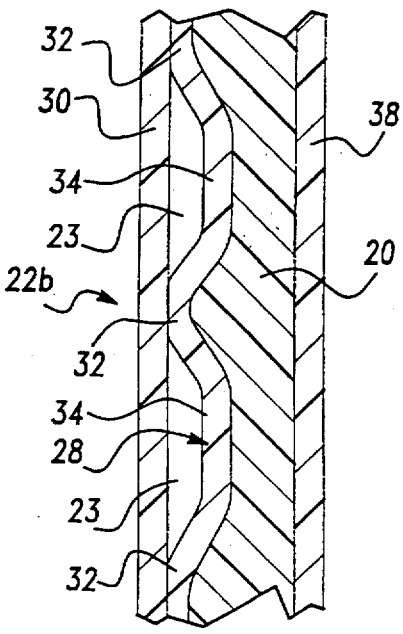
FIG. 3 is a cross-sectional view of a rollbond panel according to the principles of the present invention.

As shown in FIG. 3, the rollbond panels **22*a*–22*c* include a formed plate 28 attached to a generally flat plate 30. The formed plate 28 is preferably a heat conducting metal such as aluminum. Formed plate 28 includes a plurality of connecting portions 32 which are bonded to generally flat plate 30. Formed plate 28 also includes a plurality of passage defining portions 34 which define the fluid passages 23 which are preferably defined in a serpentine fashion as shown in FIG. 2. The formed plate members 28 are bonded to the generally flat plate 30 at contact portions 32 by welding, adhesives, or other known bonding techniques. The insulating material 20, such as foam, can be injected between the rollbond panel and the food lining 38 of the cooling storage compartments 16**.

The rollbond panels **22*a*–22*c* can be integrally formed and then bent into the inverted U-shape shown in FIG. 2**.

Alternatively, panels 22a–22c can be independently formed and then connected to one another using sufficient seals for connection therebetween so that a continuous fluid passage 23 is provided between inlet 24 and outlet 26. Inlet 24 and outlet 26 are generally tubular shaped conduits which communicate with passages 23 and are provided with a seal 40 around an annular surface thereof.

Inlet 24 and outlet 26 communicate with fluid storage vessel 46 of energy transfer system 12. Fluid storage vessel 46 can be provided with cooling fins and/or a fan in order to facilitate cooling of the fluid contained therein.

Figure 4:
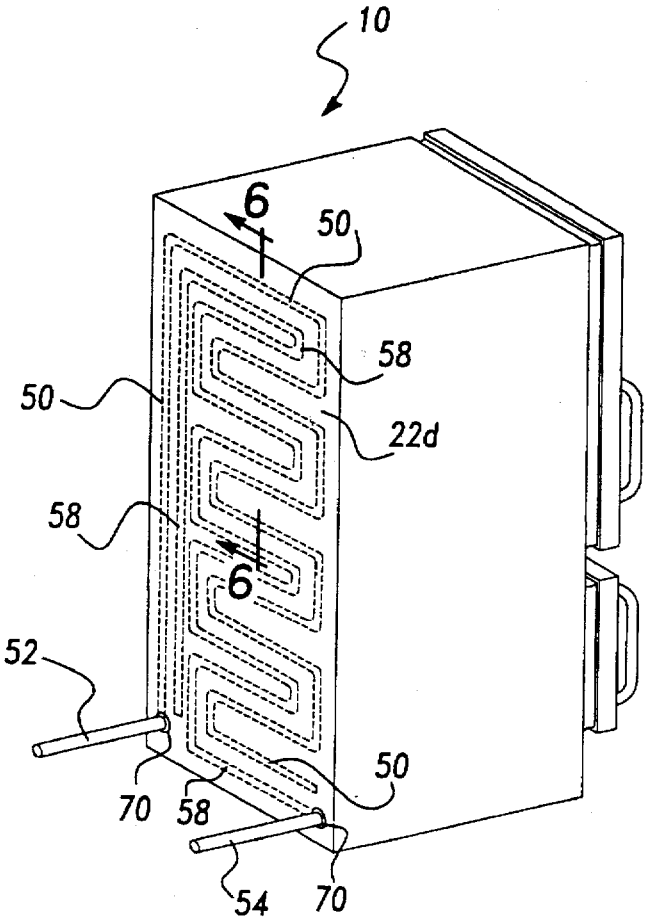
FIG. 4 is a perspective view of the refrigerator shown in FIG. 1, illustrating the serpentine fluid passages along with the condenser passages disposed in the rear wall of the refrigerator or freezer according to the present invention.
Figure 6:
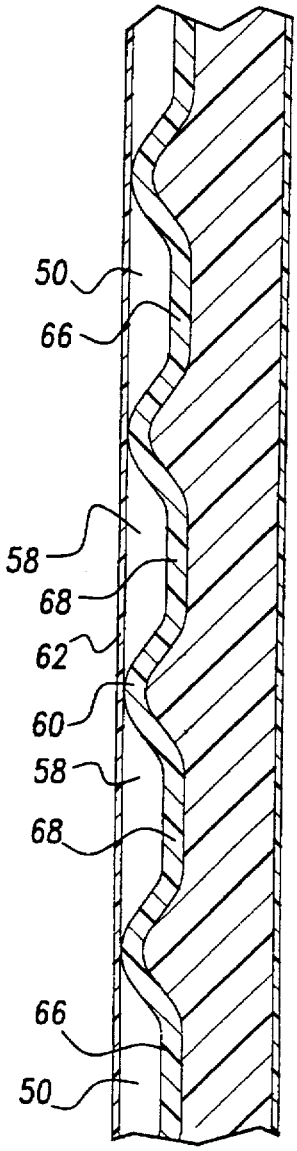
FIG. 6 is a cross-sectional view taken along line 6—6 of FIG. 4.
Figure 5:
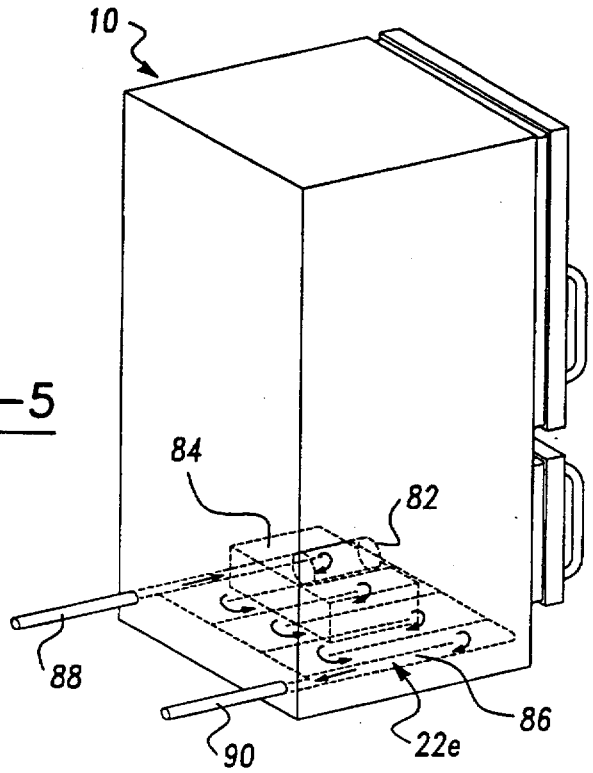
FIG. 5 is a perspective view of the refrigerator shown in FIG. 1, illustrating the fluid passages disposed in the bottom portion of the refrigerator for cooling the compressor.

The rear wall of the refrigerator 10 is provided with a rollbond panel 22d as shown in FIG. 4. Rollbond panel 22d includes a first fluid passage 50 which communicates with inlet 52 and outlet 54. Inlet 52 and outlet 54 communicate with fluid storage vessel 46 of energy transfer system 12. A condenser passage 58 is disposed adjacent to fluid passage 50. Fluid passage 50 and condenser passage 58 are each preferably formed in a serpentine fashion as shown in FIG. 4. With reference to FIG. 6, the fluid passage 50 and condenser passage 58 are defined by a formed plate member 60 which is bonded to generally fiat plate member 62 by connecting portions 64. Formed plate member 60 is preferably a heat conducting metal sheet such as aluminum and includes fluid passage defining portions 66 and condenser forming portions 68. The inlet 52 and outlet 54 are generally formed from conduits which are connected to the inlet and outlet ends of fluid passage 50. Annular seals 70 are provided around the annular surface of the conduits 52, 54 to connect the conduits 52, 54 to the fluid passage 50.

With reference to FIG. 1, the refrigeration mechanism of refrigerator 10 includes a compressor 80 which is disposed in a compartment 82 provided in a bottom portion of the refrigerator 10. Compressor 80 is disposed above rollbond panel 22e. Compressor 80 preferably includes an oil cooling system including an oil sump 84 adjacent to rollbond panel 22e. Energy transfer from the oil sump 84 to the rollbond panel 22e helps to cool the compressor 80. Rollbond panel 22e is formed similarly to the rollbond panels 22a–22c as illustrated in FIG. 3. Rollbond panel 22e includes a fluid passage 86 connected to an inlet 88 and outlet 90. Fluid inlet 88 and outlet 90 are each connected to the fluid vessel 46 of energy transfer system 12. It should be noted that each of the inlets 24, 52, and 88 are connected to fluid passage line 92 which runs through the wall 94 of a dwelling. A pump 96 is disposed in line 92 for pumping cooled fluid from vessel 46 through the passages 23 and 50 of rollbond panels 22a–22e. Pump 96 can be provided with variable speeds for increasing or decreasing the mass flow rate of cooling fluid through the fluid passages for controlling the cooling of the refrigerator unit 10. Furthermore, a valve 98 can be provided in fluid line 92 for controlling the fluid flow.

Figure 9:
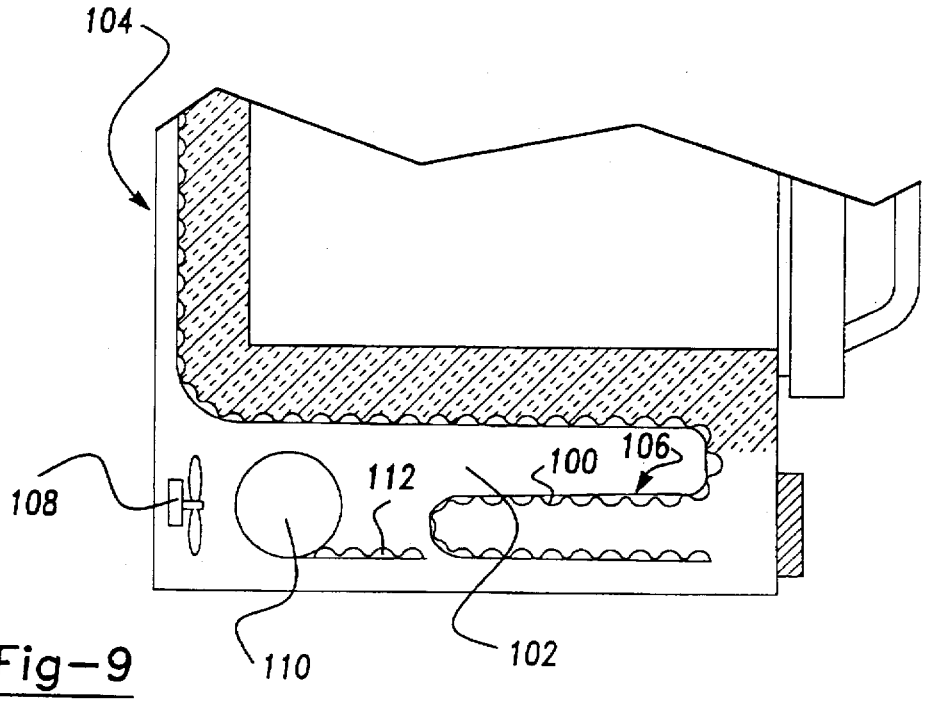
FIG. 9 is a schematic view illustrating alternative methods for cooling the condenser and for cooling the oil in the compressor.

As shown in FIG. 9, the condenser 100 can be disposed in the bottom compartment 102 of the refrigerator 104. The condenser 100 is integrally formed in a roll-bond panel 106. Roll-bond panel 106 is also provided with a cooling fluid passage similarly to the roll-bond panel illustrated in FIG. 6. The roll-bond panel 106 is folded within the bottom compartment 102. A fan 108 is located in the bottom compartment 102 for forced convection cooling of the condenser 100. The compressor 110 is also located in the bottom compartment 102. The compressor 110 is also provided with a roll-bond panel 112 which includes a fluid passage for the cooling oil of the compressor 110 as well as a fluid passage for the cooling fluid from the fluid storage vessel 46. Roll-bond panel 112 is constructed similar to the roll-bond panel illustrated in FIG. 6. Each of the roll-bond panels 106 and 112 are provided with fittings for connecting with fluid passage lines which extend to the external fluid storage vessel 46. In addition, the condenser 100, which is integrally formed in roll-bond panel 106, is provided with fittings for connection with the refrigerant lines of the refrigeration system. The roll-bond panel 112 is also provided with fittings for attachment to compressor oil lines or an oil sump of the compressor 110.

Fluid vessel 46 can be disposed outdoors, underground, or in a basement of the household. When the vessel 56 is disposed outdoors, the cooler temperatures of the winter months can be taken advantage of for transferring heat away from the refrigerator 10 and its components. However, during the warmer summer months, it may be advantageous to locate the fluid vessel 46 underground where a constant temperature of approximately 55° F. is maintained.

Figure 7:
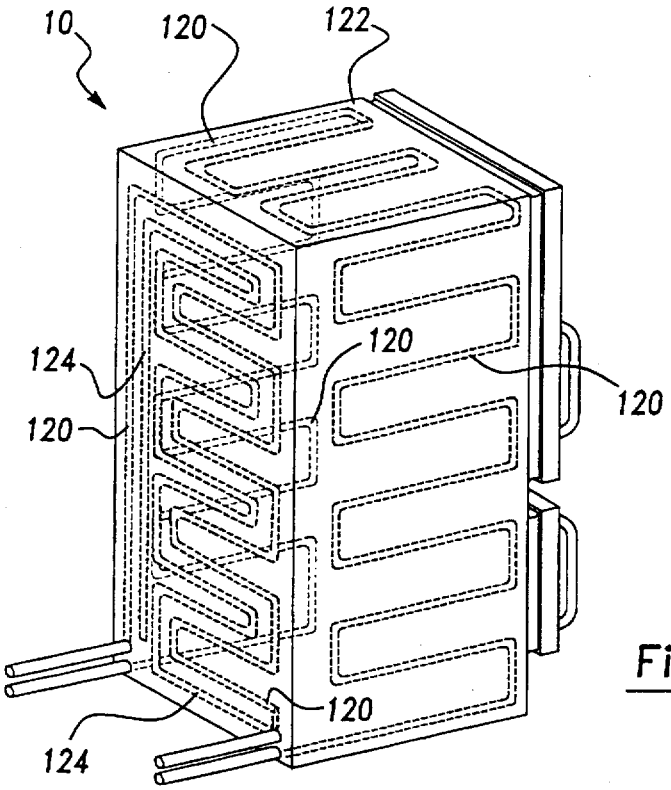
FIG. 7 is a perspective view of a household refrigeration appliance in accordance with the present invention wherein serpentine tubes are disposed in the walls of the housing.
Figure 8:
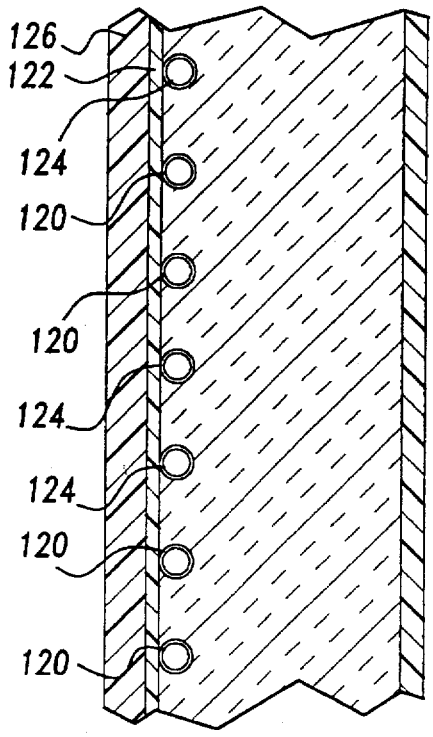
FIG. 8 is a cross-sectional view of a wall of the refrigeration appliance shown in FIG. 7.

It should also be noted that the fluid passages through the housing of the refrigerator unit may also be defined by serpentine tubes 120 disposed within the walls of the housing 122 as shown in FIGS. 7 and 8. The condenser tubes 124 can be provided with a serpentine passage disposed adjacent to serpentine tubes 120.

A thin insulating layer 126 is disposed on the outside surface of the refrigerator housing 122, as shown in FIG. 8. The insulating layer 126 can be a plastic exterior or another insulating material such as a thick coat of paint. The insulating layer helps to prevent condensation of atmospheric moisture on the cabinet surface.

As shown in FIG. 1, a humidity sensor 130 can be provided for reducing the circulation of the cooling fluid when the temperature of the cabinet exterior reaches the dew point of the kitchen air. This is to avoid the condensation of atmospheric moisture on the cabinet surfaces. In this case, a controller 132 would be provided which monitors the humidity of the room as well as the temperature of the cabinet as detected by temperature sensor 134. When the temperature of the cabinet approaches the dew point at the detected humidity level, the controller 132 would reduce the flow rate of pump 96 or shut it off completely if necessary. Although the controller and humidity sensor are shown separate from the refrigerator housing, it should be understood that these may be attached to or built into the housing.

The fluid used for the energy transfer system 12 according to the present invention can be brine or an antifreeze preferably having a low freezing temperature, below for example 0° F.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A refrigeration or freezer appliance, comprising:

a housing surrounding a cooling storage compartment;

refrigeration means for cooling said cooling storage compartment, said refrigeration means having components including a compressor and a condenser;

at least one fluid passage disposed adjacent to said cooling storage compartment and having a first inlet and a first outlet for enabling ingress and egress of a cooling fluid;

a vessel disposed external of said housing for containing said cooling fluid, said first inlet and said first outlet being connected to said vessel; and a pump for pumping said cooling fluid through said at least one fluid passage in order to aid in cooling said storage compartment in addition to cooling provided by the refrigeration means.

2. The appliance according to claim 1, wherein said at least one fluid passage is disposed in a rollbond panel.

3. The appliance according to claim 1, wherein said at least one fluid passage is defined by a serpentine tube.

4. The appliance according to claim 1, wherein said condenser includes a passage disposed adjacent to said at least one fluid passage.

5. The appliance according to claim 1, wherein said at least one fluid passage is disposed in at least one sidewall of said housing.

6. The appliance according to claim 1, wherein said at least one fluid passage is disposed in a rear wall of said housing.

7. The appliance according to claim 1, wherein said compressor is cooled by a fluid, said compressor including a sump for containing said fluid, said at least one fluid passage being disposed adjacent to said sump for cooling said fluid in said sump.

8. The appliance according to claim 1, wherein said vessel is exposed to outside air.

9. The appliance according to claim 1, wherein said vessel is disposed underground.

10. The appliance according to claim 1, wherein said fluid is brine.

11. The appliance according to claim 1, wherein said fluid has a freezing temperature below 0° F.

12. The appliance according to claim 1, wherein said at least one fluid passage is disposed adjacent to said compressor.

13. The appliance according to claim 1, wherein said first inlet is provided with a valve for controlling passage of fluid through said first inlet.

14. The appliances according to claim 1, wherein said pump includes variable speeds for controlling the rate of flow of said fluid.

15. The appliance according to claim 1, wherein said vessel includes heat exchanger fins.

16. The appliance according to claim 1, wherein said at least one fluid passage includes a first fluid passage disposed adjacent to said compressor, a second fluid passage disposed adjacent to said condenser, and a third fluid passage disposed in at least one sidewall of said housing.

17. The appliance according to claim 1, further comprising a humidity sensor for detecting a humidity level around said appliance, a temperature sensor for detecting a surface temperature of said appliance, and means for adjusting a flow rate of fluid through said at least one fluid passage when said surface temperature is within a predetermined range from a dew point temperature of the detected humidity level.

18. The appliance according to claim 1, wherein said pump cycles fluid through said at least one fluid passage to and from said vessel.

* * * * *

UNITED STATES PATENT AND TRADEMARK OFFICE

CERTIFICATE OF CORRECTION

PATENT NO. : 5,666,817

DATED : September 16, 1997

INVENTOR(S) : Edward R. Schulak and J. Benjamin Horvay

It is certified that error appears in the above-identified patent and that said Letters Patent is hereby corrected as shown below:

Column 1 of the cover page, under [56] References Cited under FOREIGN PATENT DOCUMENTS, please add the following patent which was not included on the printed patent:

WO 94/15158 07/1994 WIPO

Signed and Sealed this

Nineteenth Day of May, 1998

Bruce Lehman

*Attest:*

BRUCE LEHMAN

*Attesting Officer*

*Commissioner of Patents and Trademarks*